US005972852A

United States Patent [19]

Robson

[11] Patent Number: 5,972,852

[45] Date of Patent: Oct. 26, 1999

[54] ESTER-FREE SYNTHETIC LUBRICATING OILS COMPRISING POLYBUTENYL SUBSTITUTED SUCCINIC ACID OR ANHYDRIDE AND HYDROCARBON POLYMER

[75] Inventor: Robert Robson, Oxfordshire, United Kingdom

[73] Assignee: Exxon Chemical Patents, Inc., Linden, N.J.

[21] Appl. No.: 08/817,009

[22] PCT Filed: May 22, 1996

[86] PCT No.: PCT/EP96/02269

§ 371 Date: Oct. 14, 1997

§ 102(e) Date: Oct. 14, 1997

[87] PCT Pub. No.: WO96/39478

PCT Pub. Date: Dec. 12, 1996

[30] Foreign Application Priority Data

Jun. 5, 1995 [GB] United Kingdom ..... 9511266

[51] Int. Cl.[6] ..... C10M 161/00

[52] U.S. Cl. ..... 508/306; 508/506

[58] Field of Search ..... 508/306, 506

[56] References Cited

U.S. PATENT DOCUMENTS

| | | | |
|---|---|---|---|
| 3,288,714 | 11/1966 | Osuch | 508/306 |
| 3,876,550 | 4/1975 | Holubec | 508/306 |
| 4,877,557 | 10/1989 | Kaneshige et al. | 508/306 |
| 4,908,146 | 3/1990 | Smith, Jr. | 508/506 |
| 4,940,552 | 7/1990 | Cengel et al. | 252/51.5 A |
| 5,225,094 | 7/1993 | Pillon et al. | 508/306 |
| 5,316,696 | 5/1994 | Tury | 508/306 |

FOREIGN PATENT DOCUMENTS

| | | |
|---|---|---|
| 0096539 | 12/1983 | European Pat. Off. . |
| 0496486 | 7/1992 | European Pat. Off. . |
| 2057494 | 4/1981 | United Kingdom . |

*Primary Examiner*—Jerry D. Johnson

*Attorney, Agent, or Firm*—Ohlandt, Greeley, Ruggiero & Perle

[57] ABSTRACT

Synthetic lubricating oils for use in lubricating internal combustion engines, having good compatibility with elastomeric seals and good stability, but without making use of organic acid ester basestocks, comprise a synthetic basestock such as polyalphaolefin oligomers, an additive package comprising a hydrocarbyl substituted dicarboxylic acid or anhydride in which the hydrocarbyl group has a number average molecular weight ($\bar{M}_n$) of from 700 to 5000 and a viscosity modifier.

6 Claims, No Drawings

ESTER-FREE SYNTHETIC LUBRICATING OILS COMPRISING POLYBUTENYL SUBSTITUTED SUCCINIC ACID OR ANHYDRIDE AND HYDROCARBON POLYMER

This invention relates to synthetic lubricating oils for use in lubricating internal combustion engines, having good compatibility with elastomeric seals and good stability.

Multigrade lubricating oils typically are identified by designations such as SAE 10W-30, 5W-30 etc. The first number in the multigrade designation is associated with a maximum low temperature (e.g., −20° C.) viscosity requirement for that multigrade oil as measured typically by a cold cranking simulator (CCS) under high shear rates (ASTM D5293, which is a revision of ASTM D2602), while the second number in the multigrade designation is associated with a high temperature viscosity requirement usually measured in terms of the kinematic viscosity (kV) at 100° C. (ASTM D445). Thus, each particular multigrade oil must simultaneously meet both strict low and high temperature viscosity requirements, set e.g. by SAE specifications such as SAE J300, in order to qualify for a given multigrade oil designation.

The high temperature viscosity requirement is intended to prevent the oil from thinning out too much during engine operation which can lead to excessive wear and oil consumption. The maximum low temperature viscosity requirement is intended to facilitate engine starting in cold weather. Reduced low temperature viscosity will also help to ensure pumpability, i.e., the cold oil should readily flow to the oil pump, otherwise the engine can be damaged due to insufficient lubrication.

The viscosity characteristic of a basestock on which a lubricating oil is based is typically expressed by the neutral number of the oil (e.g., S150N) with a higher neutral number being associated with a higher viscosity at a given temperature. Blending basestocks is one way of modifying the viscosity properties of the resulting lubricating oil. The basestocks which are typically used in lubricating oils may be synthetic or natural oils. Unfortunately, merely blending basestocks of different viscosity characteristics may not enable the formulator to meet the low and high temperature viscosity requirements of some multigrade oils. The formulator's primary tool for achieving this goal is an additive conventionally referred to as a viscosity modifier (VM) or viscosity index improver (V.I. improver).

A monofunctional VM is conventionally an oil-soluble long chain polymer. A multifunctional VM (or alternately MFVM) is an oil soluble polymer which has been chemically modified e.g., functionalized and derivatized, to impart dispersancy as well as viscosity modification.

For multigrade oils to meet the high temperature viscosity requirements, it is often necessary to add significant amounts of VM which in turn results in increased low temperature viscosity. In order to meet the requirements for wide multigrades such as SAE 5W-20, 5W-30, 10W40, 10W-50, 15W-40 and 15W-50, it is usual to reduce the basestock viscosity by blending in less viscous oils—i.e. to lower the average neutral number of the total basestock. If conventional mineral basestocks are used it is usual to replace higher viscosity basestocks such as 600N basestock in part by basestock of 150N or less to improve CCS performance in wide multigrades. This results in the formulated oil becoming more volatile which may in turn increase oil consumption.

An alternative means of reducing the basestock viscosity and therefore improving CCS performance is to employ so-called non-conventional lubricants (or NCL). Examples of NCLs are synthetic basestocks such as polyalphaolefin oligomers (PAO) and diesters and specially processed mineral basestocks such as basestocks, waxes or other heavy fractions which are hydrocracked or hydroisomerised to give greater paraffinic content and lower aromatic content.

The American Petroleum Institute (API) in their Publication 1509 dated January 1993, amended as of Jan. 1st 1995, entitled "Engine Oil Licensing and Certification System" (EOLCS) in Appendix E, 1.2 provided a classification of basestocks in 5 categories, which are widely used in the lubricant industry. Conventional mineral basestocks are in Groups 1 and 2; NCLs are basestocks that do not fall within those two Groups.

In addition increasingly severe performance requirements for lubricants as well as environmental considerations has lead to increasing use of synthetic basestocks, to the extent of lubricants becoming fully synthetic—i.e., using only synthetic basestocks. However, such synthetic lubricants have not previously been formulated with polyalphaolefin oligomers as the basestock without ester basestocks being used in addition to provide seal compatibility, particularly with fluorocarbon seals, and adequate solubility of the additives used to formulate the lubricants. Inadequate additive solubility in the basestock gives rise to problems of stability with additives tending to fall out of solution on storage, which is clearly unacceptable. Synthetic ester basestocks have drawbacks—for example, they may give rise to excessive wear of valve train components.

Additives which enhance the seal compatibility of conventional lubricants are known. U.S. Pat. No. 4,940,552 and Research Disclosures, May 1992, No. 337, page 348 describe the use of dicarboxylic acid anhydrides for this purpose but there is no indication of how the problem is addressed in fully synthetic lubricants, or any mention of dealing with solubility issues in synthetic basestocks.

Thus, in one aspect the invention provides a synthetic lubricating oil for an internal combustion engine which comprises:

a. a synthetic basestock of lubricating oil viscosity substantially free of both natural oils and synthetic organic acid ester oils;

b. an additive package comprising a hydrocarbyl substituted dicarboxylic acid or anhydride in which the hydrocarbyl group has a number average molecular weight ($\overline{M}_n$) of from 700 to 5000; and c. a viscosity modifier.

DETAILED DESCRIPTION

A. Basestock

The basestock used in the lubricating oil of the invention comprises synthetic oils other than ester oils, and is substantially free of natural oils so that the lubricating oil may be described as fully synthetic.

Additives used in formulating lubricating oils often contain diluent oil; this diluent oil introduced with additives is not included within the term "basestock" as that term is used herein, which is confined to the oil used to dilute the additives to form the finished lubricating oil. Thus, it is not excluded that the lubricating oils may contain small amounts of natural oils introduced in the form of such diluents, but typically the amounts of such natural diluent oils will amount to no more than 18% by weight of the finished lubricating oil.

The lubricating oil basestock conveniently has a viscosity of from 2.5 to 12 $mm^2/s$, and preferably from 2.5 to 9 $mm^2/s$, at 100° C. Non-organic-acid-ester synthetic basestocks include chlorofluorocarbon polymers, silicones, silicate esters, fluoresters and polyphenyl ethers, but polyalphaolefin oligomers (PAO) are particularly preferred. Commercially available PAO basestocks of this type include: SHF 41, 61 and 82 available from Mobil Corporation, Synfluid 2, 4 and 6 available from Oronite and Durasyn 106 and 164 available from Albemarle Corporation.

B. Additive Package

1. Hydrocarbyl Substituted Dicarboxylic Acid or Abhydride

The additive package used in the invention comprises the additives which provide the desired performance characteristics for the finished lubricating oil. The invention requires that this package contain a hydrocarbyl substituted dicarboxylic acid or anhydride in which the hydrocarbyl group has a number average molecular weight ($\overline{M}_n$) of from 700 to 5000.

The hydrocarbyl group is typically an olefin polymer, especially a polymer comprising a major molar amount (i.e. greater than 50 mole %) of a $C_2$ to $C_{18}$ olefin (e.g., ethylene, propylene, butylene, isobutylene, pentene, octene-1, styrene), and typically a $C_2$ to $C_5$ olefin. The oil soluble polymeric hydrocarbon backbone may be a homopolymer (e.g. polypropylene or polyisobutylene) or a copolymer of two or more of such olefins (e.g. copolymers of ethylene and an alpha-olefin such as propylene and butylene or copolymers of two different alpha-olefins). Other copolymers include those in which a minor molar amount of the copolymer monomers, e.g., 1 to 10 mole %, is a $C_3$ to $C_{22}$ non-conjugated diolefin (e.g., a copolymer of isobutylene and butadiene, or a copolymer of ethylene, propylene and 1,4-hexadiene or 5-ethylidene-2-norbornene).

One preferred class of olefin polymers is polybutenes and specifically polyisobutenes (PIB) or poly-n-butenes, such as may be prepared by polymerization of a $C_4$ refinery stream.

Another preferred class of olefin polymers is ethylene alpha-olefin (EAO) copolymers or alpha-olefin homo- and copolymers having in each case a high degree (e.g. >30%) of terminal vinylidene unsaturation. That is, the polymer has the structure: P-HCR=$CH_2$ wherein P is the polymer chain and R is a $C_1$–$C_{18}$ alkyl group, typically methyl or ethyl. Preferably the polymers have at least 50% of the polymer chains with terminal vinylidene unsaturation. EAO copolymers of this type preferably contain 1 to 50 wt. % ethylene, and more preferably 5 to 45 wt. % ethylene. Such polymers may contain more than one alpha-olefin and may contain one or more $C_3$ to $C_{22}$ diolefins. Also usable are mixtures of EAO's of low ethylene content with EAO's of high ethylene content. The EAO's may also be mixed or blended with PIB's of various $\overline{M}_n$'s or components derived from these may be mixed or blended. Atactic propylene oligomer typically having $\overline{M}_n$ of from 700 to 500 may also be used, as described in EP-A-490454.

Suitable olefin polymers and copolymers, such as polyisobutenes, may be prepared by cationic polymerization of hydrocarbon feedstreams, usually $C_3$–$C_5$, in the presence of a strong Lewis acid catalyst and a reaction promoter, usually an organoaluminum such as HCl or ethylaluminum dichloride. Tubular or stirred reactors may be used. Such polymerizations and catalysts are described, e.g., in U.S. Pat. Nos. 4,935,576 and 4,952,739. Fixed bed catalyst systems may also be used as in U.S. Pat. No. 4,982,045 and UK-A 2,001,662. Most commonly, polyisobutylene polymers are derived from Raffinate I refinery feedstreams. Conventional Ziegler-Natta polymerization may also be employed to provide olefin polymers suitable for use to prepare dispersants and other additives.

The preferred EAO polymers may be prepared by polymerizing the appropriate monomers in the presence of a catalyst system comprising at least one metallocene (e.g. a cyclopentadienyl-transition metal compound) and preferably an activator, e.g. an alumoxane compound. The metallocenes may be formed with one, two, or more cyclopentadienyl groups, which are substituted or unsubstituted. The metallocene may also contain a further displaceable ligand, preferably displaced by a cocatalyst—a leaving group—that is usually selected from a wide variety of hydrocarbyl groups and halogens. Optionally there is a bridge between the cyclopentadienyl groups and/or leaving group and/or transition metal, which may comprise one or more of a carbon, germanium, silicon, phosphorus or nitrogen atom-containing radical. The transition metal may be a Group IV, V or VI transition metal. Such polymerizations and catalysts are described, for example, in U.S. Pat Nos. 4,871,705, 4,937,299, 5,017,714, 5,120,867, 4,665,208, 5,153,157, 5,198,401, 5,241,025, 5,057,475, 5,096,867, 5,055,438, 5,227,440, 5,064,802; EP-A-129368, 520732, 277003, 277004, 420436; WO91/04257, 93/08221, 93/08199 and 94/13715.

The $\overline{M}_n$ for such polymers can be determined by several known techniques. A convenient method for such determination is by gel permeation chromatography (GPC) which additionally provides molecular weight distribution information, see W. W. Yau, J. J. Kirkland and D. D. Bly, "Modern Size Exclusion Liquid Chromatography", John Wiley and Sons, New York, 1979.

The dicarboxylic acid or anhydride is preferably a succinic acid or anhydride. These preferred products may be prepared by known functionalisation reactions which include: halogenation of the polymer at an olefinic bond and subsequent reaction of the halogenated polymer with maleic acid or anhydride; and reaction of the polymer with maleic acid or anhydride by the "ene" reaction absent halogenation. Particularly preferred succinic anhydrides are those with a polyisobutenyl backbone, typically having an $\overline{M}_n$ of from 700 to 2500, for example 900 to 1100.

The dicarboxylic acid or anhydride is typically used in the additive package in an amount such that it is present in the finished oil in an amount of from 0.01 to 5 mass %. Preferably it is used in an amount corresponding to it being present in the oil in an amount of from 0.1 to 1 mass %.

Additional additives present in the additive package typically include ashless dispersants, metal or ash-containing detergents, antioxidants, anti-wear agents, friction modifiers, rust inhibitors, anti-foaming agents, demulsifiers, and pour point depressants.

2. Ashless Dispersant

The ashless dispersant comprises an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The oil soluble polymeric hydrocarbon backbone is typically an olfin polymer as described above, and will usually have number average molecular weight ($\overline{M}_n$) within the range of from 300 to 20,000. The $\overline{M}_n$ of the backbone is preferably within the range of 500 to 10,000, more preferably 700 to 5,000 where the use of the backbone is to prepare a component having the primary function of dispersancy. Hetero polymers such as polyepoxides are also usable to prepare components. Both relatively low molecular weight ($\overline{M}_n$ 500 to 1500) and relatively high molecular weight ($\overline{M}_n$ 1500 to 5,000 or greater) polymers are useful to make dispersants. Particularly useful olefin polymers for use in dispersants have $\overline{M}_n$ within the range of from 1500 to 3000.

The oil soluble polymeric hydrocarbon backbone may be functionalized to incorporate a functional group into the backbone of the polymer, or as pendant groups from the polymer backbone. The functional group typically will be polar and contain one or more hetero atoms such as P, O, S, N, halogen, or boron. It can be attached to a saturated hydrocarbon part of the oil soluble polymeric hydrocarbon backbone via substitution reactions or to an olefinic portion via addition or cycloaddition reactions. Alternatively, the functional group can be incorporated into the polymer by oxidation or cleavage of a small portion of the end of the polymer (e.g., as in ozonolysis).

Useful functionalization reactions include: halogenation of the polymer at an olefinic bond and subsequent reaction of the halogenated polymer with an ethylenically unsaturated functional compound; reaction of the polymer with an unsaturated functional compound by the "ene" reaction absent halogenation (an example of the former functionalization is maleation where the polymer is reacted with maleic acid or anhydride); reaction of the polymer with at least one phenol group (this permits derivatization in a Mannich Base-type condensation); reaction of the polymer at a point of unsaturation with carbon monoxide using a Koch-type reaction to introduce a carbonyl group in an iso or neo position; reaction of the polymer with the functionalizing compound by free radical addition using a free radical catalyst; reaction with a thiocarboxylic acid derivative; and reaction of the polymer by air oxidation methods, epoxidation, chloroamination, or ozonolysis.

The functionalized oil soluble polymeric hydrocarbon backbone is then further derivatized with a nucleophilic amine, amino-alcohol, or mixture thereof to form oil soluble salts, amides, imides, amino-esters, and oxazolines. Useful amine compounds include hydrocarbyl amines or may be predominantly hydrocarbyl amines in which the hydrocarbyl group includes other groups, e.g., hydroxy groups, alkoxy groups, amide groups, nitriles, imidazoline groups, and the like. Particularly useful amine compounds include mono- and polyamines, e.g. polyalkylene and polyoxyalkylene polyamines of about 2 to 60, conveniently 2 to 40 (e.g., 3 to 20), total carbon atoms and about 1 to 12, conveniently 3 to 12, and preferably 3 to 9 nitrogen atoms in the molecule. Mixtures of amine compounds may advantageously be used such as those prepared by reaction of alkylene dihalide with ammonia. Preferred amines are aliphatic saturated amines, including, e.g., 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,2-propylene)triamine.

Other useful amine compounds include: alicyclic diamines such as 1,4-di(aminomethyl)cyclohexane, and heterocyclic nitrogen compounds such as imidazolines. A particularly useful class of amines are the polyamido and related amido-amines as disclosed in U.S. Pat. Nos. 4,857,217; 4,956,107; 4,963,275; and 5,229,022. Also usable is tris(hydroxymethyl)amino methane (THAM) as described in U.S. Pat. Nos. 4,102,798; 4,113,639; 4,116,876; and UK 989,409. Dendrimers, star-like amines, and comb-structure amines may also be used. Similarly, one may use the condensed amines disclosed in U.S. Pat. No. 5,053,152. The functionalized polymer is reacted with the amine compound according to conventional techniques as described in EP-A 208,560; U.S. Pat. No. 4,234,435 and U.S. Pat. No. 5,229,022.

A preferred group of nitrogen containing ashless dispersants includes those derived from polyisobutylene substituted with succinic anhydride groups and reacted with polyethylene amines (e.g. tetraethylene pentamine, pentaethylene, polyoxypropylene diamine) aminoalcohols such as trismethylolaminomethane and optionally additional reactants such as alcohols and reactive metals e.g. pentaerythritol, and combinations thereof).

Also useful as nitrogen containing ashless dispersants are dispersants wherein a polyamine is attached directly to the long chain aliphatic hydrocarbon as shown in U.S. Pat. Nos. 3,275,554 and 3,565,804 where a halogen group on a halogenated hydrocarbon is displaced with various alkylene polyamines. Another class of nitrogen-containing is ashless dispersants comprises Mannich base condensation products. Such Mannich condensation products may include a long chain, high molecular weight hydrocarbon (e.g., $\overline{M}_n$ of 1,500 or greater) on the benzene group or may be reacted with a compound containing such a hydrocarbon, for example, polyalkenyl succinic anhydride as shown in U.S. Pat. No. 3,442,808.

Examples of dispersants prepared from polymers prepared from metallocene catalysts and then functionalized, derivatized, or functionalized and derivatized are described in U.S. Pat. Nos. 5,266,223, 5,128,056, 5,200,103, 5,225,092, 5,151,204 and 5,334,775; WO-A-94/13709 and 94/19436; and EP-A-440506, 513211 and 513157.

The functionalizations, derivatizations, and post-treatments described in the following patents may also be adapted to functionalize and/or derivatize the preferred polymers described above: U.S. Pat. Nos. 3,275,554, 3,565,804, 3,442,808, 3,442,808, 3,087,936 and 3,254,025.

3. Detergent

Metal-containing or ash-forming detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number or TBN (as may be measured by ASTM D2896) of from 0 to 80. It is possible to include large amounts of a metal base by reacting an excess of a metal compound such as an oxide or hydroxide with an acidic gas such as carbon dioxide. The resulting overbased detergent comprises neutralised detergent as the outer layer of a metal base (e.g. carbonate) micelle. Such overbased detergents may have a TBN of 150 or greater, and typically of from 250 to 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450 TBN, and neutral and overbased calcium phenates and sulfurized phenates having TBN of from 50 to 450.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 wt % (preferably at least 125 wt %) of that stoichiometrically required.

Metal salts of phenols and sulfurised phenols are prepared by reaction with an appropriate metal compound such as an oxide or hydroxide and neutral or overbased products may be obtained by methods well known in the art. Sulfurised phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

4. Antiwear and Antioxidant Agent

Dihydrocarbyl dithiophosphate metal salts are frequently used as anti-wear and antioxidant agents. The metal may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt any basic or neutral zinc compound could be used but the oxides, hydroxides and carbonates are most generally employed. Commercial additives frequently contain an excess of zinc due to use of an excess of the basic zinc compound in the neutralization reaction.

The preferred zinc dihydrocarbyl dithiophosphates are oil soluble salts of dihydrocarbyl dithiophosphoric acids and may be represented by the following formula:

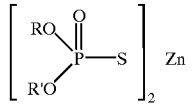

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates. Conveniently at least 50 (mole) % of the alcohols used to introduce hydrocarbyl groups into the dithiophosphoric acids are secondary alcohols.

Oxidation inhibitors or antioxidants reduce the tendency of mineral oils to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, phosphorous esters, metal thiocarbamates, oil soluble copper compounds as described in U.S. Pat. No. 4,867,890, and molybdenum containing compounds.

Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulfur atom, or a —CO—, —$SO_2$— or alkylene group) and two are directly attached to one amine nitrogen also considered aromatic amines. The aromatic rings are typically substituted by one or more substituents selected from alkyl, cycloalkyl, alkoxy, aryloxy, acyl, acylamino, hydroxy, and nitro groups.

5. Other Additives

Friction modifiers may be included to improve fuel economy. Oil-soluble alkoxylated mono- and diamines are well known to improve boundary layer lubrication. The amines may be used as such or in the form of an adduct or reaction product with a boron compound such as a boric oxide, boron halide, metaborate, boric acid or a mono-, di- or trialkyl borate.

Other friction modifiers include esters formed by reacting carboxylic acids and anhydrides with alkanols. Other conventional friction modifiers generally consist of a polar terminal group (e.g. carboxyl or hydroxyl) covalently bonded to an oleophillic hydrocarbon chain. Esters of carboxylic acids and anhydrides with alkanols are described in U.S. Pat. No. 4,702,850. Examples of other conventional friction modifiers are described by M. Belzer in the "Journal of Tribology" (1992), Vol. 114, pp. 675–682 and M. Belzer and S. Jahanmir in "Lubrication Science" (1988), Vol. 1, pp. 3–26.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfonamides of thiadiazoles such as those described in UK. Patent Specification No. 1,560,830. Benzotriazoles derivatives also fall within this class of additives. When these compounds are included in the lubricating composition, they are preferably present in an amount not exceeding 0.2 wt % active ingredient.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers and polyalkylmethacrylates.

Foam control can be provided by many compounds including an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and does not require further elaboration.

C. Viscosity Modifiers

The viscosity modifier may be monofunctional or multifunctional. Suitable compounds for use as monofunctional viscosity modifiers are generally high molecular weight hydrocarbon polymers, including polyesters. Oil soluble viscosity modifying polymers generally have weight average molecular weights of from about 10,000 to 1,000,000, preferably 20,000 to 500,000, which may be determined by gel permeation chromatography (as described above) or by light scattering.

Representative examples of suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

The multifunctional viscosity modifier may be one or more of: polymethacrylates derivatised with nitrogen containing monomers such as vinylpyridine, N-vinylpyrrolidinone, or N,N'-dimethylaminoethyl methacrylate; ethylene-propylene copolymers directly amine derivatised; hydrogenated star polymers reacted with a carboxylic acid derivative and then reacted with an amine; hydrogenated styrene-butadiene-ethylene oxide block copolymers; and ethylene alphaolefin copolymers solution or melt grafted with ethylenically unsaturated a dicarboxylic acid derivative and then reacted with an amine.

A preferred multifunctional viscosity modifier comprises a derivatized ethylene-alpha olefin copolymer comprising an adduct of (i) a copolymer having a number average molecular weight of from 20,000 to 100,000, functionalized with mono- or dicarboxylic acid material; and (ii) at least one amine, and in a particularly preferred aspect the ethylene-alpha olefin copolymer comprises either a) from 30 to 60 weight percent monomer units derived from ethylene and from 70 to 40 weight percent monomer units derived from alpha-olefin, or b) from 60 to 80 weight percent monomer units derived from ethylene and from 40 to 20 weight percent monomer units derived from alpha olefin, or a mixture of a) and b).

The multifunctional viscosity modifiers used in the present invention may be prepared by known techniques. The preferred mixture of derivatized ethylene-alpha olefin copolymers may be prepared by functionalising and derivatising ethylene alpha-olefin copolymers such as described in EP-A-616616 and WO-A-94/13763.

The viscosity modifier used in the invention will be used in an amount to give the required viscosity characteristics. Since they are typically used in the form of oil solutions the amount of additive employed will depend on the concentration of polymer in the oil solution comprising the additive. However by way of illustration, typical oil solutions of polymer used as VMs are used in amount of from 1 to 30% of the blended oil. The amount of VM as active ingredient of the oil is generally from 0.01 to 6 wt %, and more preferably from 0.1 to 2 wt %.

When lubricating compositions contain one or more of the above-mentioned additives, each additive is typically blended into the base oil in an amount which enables the additive to provide its desired function. Representative effective amounts of such additives, when used in crankcase lubricants, are listed below. All the values listed are stated as mass percent active ingredient.

| ADDITIVE | MASS % (Broad) | MASS % (Preferred) |
|---|---|---|
| Ashless Dispersant | 0.1–20 | 1–8 |
| Metal detergents | 0.1–15 | 0.2–9 |
| Corrosion Inhibitor | 0–5 | 0–1.5 |
| Metal dihydrocarbyl dithiophosphate | 0.1–6 | 0.1–4 |
| Anti-oxidant | 0–5 | 0.01–2 |
| Pour Point Depressant | 0.01–5 | 0.01–1.5 |
| Anti-Foaming Agent | 0–5 | 0.001–0.15 |
| Supplemental Anti-wear Agents | 0–1.0 | 0–0.5 |
| Friction Modifier | 0–5 | 0–1.5 |
| Viscosity Modifier | 0.01–10 | 0.25–3 |
| Basestock | Balance | Balance |

The components may be incorporated into a base oil in any convenient way. Thus, each of the components can be added directly to the oil by dispersing or dissolving it in the oil at the desired level of concentration. Such blending may occur at ambient temperature or at an elevated temperature.

Preferably all the additives except for the viscosity modifier and the pour point depressant are blended into a concentrate or additive package described herein as the detergent inhibitor package, that is subsequently blended into basestock to make finished lubricant. Use of such concentrates is conventional. The concentrate will typically be formulated to contain the additive(s) in proper amounts to provide the desired concentration in the final formulation when the concentrate is combined with a predetermined amount of base lubricant.

Preferably the detergent inhibitor package is made in accordance with the method described in U.S. Pat. No.

4,938,880. That patent describes making a premix of ashless dispersant and metal detergents that is pre-blended at a temperature of at least about 100° C. Thereafter the pre-mix is cooled to at least 85° C. and the additional components are added.

The final formulations may employ from 5 to 25 mass % and preferably 5 to 18 mass %, typically about 10 to 15 mass % of the concentrate or additive package with the remainder being base oil.

The invention will now be described by of illustration only with reference to the following examples. In the examples, unless otherwise noted, all treat rates of all additives are reported as mass percent active ingredient.

EXAMPLES 1 AND 2, AND COMPARATIVE EXAMPLE 3

Synthetic SAE 5W40 multigrade passenger car motor oils meeting the A.P.I. SH quality level were prepared by blending into a PAO basestock, Mobil SHF 61, an additive package with and without the use of a polyisobutenyl succinic anhydride (prepared from polyisobutene having $\overline{M}_n$ of about 950 as measured by GPC), and PARATONE 8002, an olefin copolymer monofunctional viscosity modifier available form Exxon Chemical Limited. The oils were tested for seal compatibility with FKM (SRE) AK6 fluorocarbon elastomer in the VW PV-334 test (dated Oct. 29, 1993).

The results in the following table show that the formulations of the invention were compatible with the seals, unlike the comparative formulation, and yet surprisingly gave good adequate stability and good engine performance as evidenced by the ability of the oils to meet the requirements of A.P.I. SH, despite the absence of organic acid ester in the basestock.

TABLE 1

| Example | 1 | 2 | 3 (Comparative) |
|---|---|---|---|
| Additive package (mass %) | | | |
| basic package[1] | 12.11 | 12.11 | 12.11 |
| PIBSA[2] | 0.25 | 0.5 | 0 |
| Viscosity modifier (mass %) | | | |
| PARATONE 8002 | 11.0 | 11.0 | 11.0 |
| Mobil SHF 61 (mass %) | balance to 100 | balance to 100 | balance to 100 |
| Elastomer compatibility | | | |
| Tensile strength (MPa) – pass ≧ 8.0 | 9.4 | 9.1 | 8.5 |
| Elongation at break (%) – pass ≧ 160 | 199 | 216 | 188 |
| Cracks – pass = none | none | none | yes |

Footnotes:
[1]= a detergent inhibitor package comprising ashless dispersant, metal-containg detergents, antioxidant, anti-wear additive, anti-foam additive, demulsifier, friction modifier;
[2]= a polyisobutenyl succinic anhydride (prepared from polyisobutene having $\overline{M}_n$ of about 950 as measured by GPC

I claim:

1. A stable, multigrade synthetic lubricating oil for an internal combustion engine, the lubricating oil having improved compatibility with elastomeric seals, the lubricating oil comprising:

(a) a fully synthetic polyalphaolefin oligomer basestock of lubricating viscosity substantially free of both natural oils and synthetic organic acid ester oils;

(b) an additive package comprising a polybutenyl substituted succinic acid or anhydride in which the polybutenyl group has a number average molecular weight (Mn) of from 700 to 5000; and (c) a hydrocarbon polymer viscosity modifier;

wherein the synthetic lubricating oil is more compatible with elastomeric seals than a corresponding lubricating oil without the polybutenyl substituted succinic acid or anhydride.

2. A lubricating oil as claimed in claim 1, in which the polybutenyl substituted succinic acid or anhydride is present in the basestock in an amount of from 0.01 to 5 mass %.

3. A lubricating oil as claimed in claim 2, in which the dicarboxylic acid or anhydride is present in the oil in an amount of from 0.1 to 1 mass %.

4. A lubricating oil as claimed in claim 1, in which the additive package includes one or more of ashless dispersant, metal detergent, corrosion inhibitor, anti-wear additive, antioxidant, pour point depressant, antifoam agent and friction modifier.

5. A stable, multigrade synthetic lubricating oil as claimed in claim 1, wherein the polybutenyl substituted succinic acid or anhydride is polyisobutenyl succinic anhydride in which the polyisobutenyl backbone has a Mn of from 700 to 2500 and is present in the oil in an amount of from 0.01 to 5 mass %.

6. A method for providing a stable, multigrade synthetic lubricant for an internal combustion engine and improving the compatibility of the synthetic lubricant with elastomeric seals, which method comprises adding to a fully synthetic polyalphaolefin basestock of lubricating oil viscosity substantially free of both natural oils and synthetic organic ester oils (1) a polybutenyl substituted succinic acid or anhydride in which the polybutenyl group has a number average molecular weight (Mn) of from 700 to 5000 and (2) a hydrocarbon polymer viscosity modifier.

* * * * *